United States Patent [19]

Shibata

[11] Patent Number: 4,738,472

[45] Date of Patent: Apr. 19, 1988

[54] THERMOSENSITIVE LABEL RENDERED UNUSABLE BY REMOVAL FROM ITS FIRST APPLICATION

[75] Inventor: Tomoo Shibata, Irvine, Calif.

[73] Assignee: Ricoh Electronics, Inc., Santa Ana, Calif.

[21] Appl. No.: 929,724

[22] Filed: Nov. 12, 1986

[51] Int. Cl.[4] ..... B42D 15/00; B41M 5/18

[52] U.S. Cl. ..... 283/101; 428/346; 428/352; 428/40; 283/97

[58] Field of Search ..... 283/101, 96, 97; 428/346, 352, 354, 355, 914, 40; 427/150, 151, 152; 156/DIG. 21, DIG. 32, DIG. 35, DIG. 36

[56] References Cited

U.S. PATENT DOCUMENTS

| | | | |
|---|---|---|---|
| 3,430,491 | 3/1969 | Gignillia | 73/358 |
| 3,576,761 | 4/1971 | Davis | 252/408 |
| 3,925,584 | 12/1975 | Suzuki et al. | 428/346 |
| 3,974,317 | 8/1976 | Sharpless | 428/215 |
| 3,993,809 | 11/1976 | Schranz et al. | 428/1 |
| 4,370,370 | 1/1983 | Iwata et al. | 428/40 |
| 4,424,245 | 1/1984 | Maruta et al. | 428/40 |
| 4,444,819 | 4/1984 | Maruta et al. | 346/209 |
| 4,590,497 | 5/1986 | Shibata et al. | 428/40 |
| 4,606,956 | 8/1986 | Charbonneau et al. | 428/40 |
| 4,633,276 | 12/1986 | Shibata et al. | 428/352 |

*Primary Examiner*—Paul A. Bell

*Attorney, Agent, or Firm*—Walter A. Hackler

[57] ABSTRACT

A thermosensitive label rendered unusable by removal from its first application includes a thermosensitive color-forming layer on one side of a substrate and a remoistenable adhesive on an opposite side of the substrate. The substrate is selected to have a tensile strength less than that necessary to separate the substrate from a surface after its first application thereto without ripping. The activation temperature of the thermosensitive color-forming layer is selected so that attempts to remove the label from its first application by means of heat, or steam, cause discoloration of the label.

18 Claims, 1 Drawing Sheet

THERMOSENSITIVE LABEL RENDERED UNUSABLE BY REMOVAL FROM ITS FIRST APPLICATION

The present invention is directed generally to thermosensitive recording labels and more particularly is directed to a thermosensitive label rendered unusable by removal from its first application.

Label security is an important aspect in many types of label applications, for example, postage labels and the like. It is preferable for this type of label to be secure, that is, after a specific amount of postage is printed on the label and the label attached to the deliverable package, the label should be tamper-proof so that it cannot be removed from the package. Heretofore, many postal operations have defaced the postage upon its first use by marking indelible lines thereacross so that if the label is removed it could be identified as a used postage label. However, such marking, or cancellation, is time-consuming and costly in terms of the equipment that must be provided therefor, and the maintenance of such equipment.

Hence, it can be seen that an important advantage may be had from a label which did not require cancellation, but which either could not be removed from the goods or, upon such removal, would be rendered unless for subsequent identification.

Heretofore, postage-type labels have typically been imprinted with oily or water-based inks. Most often the labels are printed on site with small portable machines, which must be serviced to replace such consumable inks. It is well known that imprinting with liquid inks is typically messy because the inks tend to smear if insufficient drying time is not provided. In addition, this type of printed label requires cancellation marks because of the permanent nature of the printing process.

Thermal printing has been developed for use with labels and the system has, in many instances, replaced conventional liquid ink printed labels in many applications. It would be desirable if thermosensitive labels could be used in the postal area because of the simplicity of the printing operation and the cleanliness of the operation.

This type of label incorporates a thermosensitive color-forming material which is disposed on a substrate and undergoes color formation upon being heated to above an activation temperature. In use, a heated printing head is utilized to apply heat to preselected portions of the label in order to produce images thereon corresponding to alphanumerical characters, or images.

No use has been made of this technology in the postal label area because the thermosensitive labels have heretofore been produced with only pressure-sensitive adhesives. This has significant disadvantage in the postal label area. First, a backing sheet must be provided to cover the pressure-sensitive adhesive during storage.

Since this backing, or liner, sheet must be removed to expose the adhesive, it represents a considerable disposable problem. In addition, because most portable postal machines are kept as small as possible, a thermal label with a backing sheet can provide only half the number of labels in a given space than a conventional label with remoistenable adhesive thereon because of the bulk of the liner.

A second disadvantage lies in the fact that the pressure-sensitive adhesives, in many cases, do not cause an acceptable permanent bond between the label and the package on which the label is placed. That is, in many instances, particularly if the label is not in place for a long period of time, the label may be peeled from the package. This encourages reuse of the label when it is not properly cancelled, or when the cancellation lines are not sufficiently indelible so they may be lightened or removed by erasure.

Thermosensitive labels have heretofore not been manufactured utilizing remoistenable adhesives because, for economical production of the labels, they must be manufactured at high speeds. During the manufacture, heat must be avoided, otherwise, undesirable color formation or total coloration of the label may occur. Since remoistenable adhesives are air-dried, this process demands an amount of time not commensurate with high-speed label production unless heat is applied to enhance the drying of the adhesive.

The present invention overcomes the disadvantages of the hereinbefore conventional postage-type labels. It has been found that remoistenable adhesive can be applied to a thermosensitive recording label substrate without heating of the thermosensitive paper to its activation temperature. In addition, when the substrate is selected having a tensile strength less than the tensile strength necessary to separate the substrate from the water active adhesive or surface after first application to the surface, a security label may be produced. That is, once applied to goods, the thermal label in accordance with the present invention, cannot be removed from the surface because the remoistenable adhesive, once dry, cannot be separated from the packaged surface which is attached, or the label cannot be separated from the adhesive without tearing of the label, thus rendering it useless for subsequent use. If moisture is applied to the label to resoften the adhesive, it also softens the substrate, thus causing even easier tearing of the label in an attempt to remove it from the goods.

If heat is applied, as for example in the form of steam, to remove the label without tearing it, the heat so applied will discolor the label and render it useless for subsequent use.

SUMMARY OF THE INVENTION

A thermosensitive label rendered unusable by removal from its first application in accordance with the present invention, includes a substrate and a water-activated adhesive disposed on one side of the substrate which provides means for attaching the substrate to a surface. To ensure that the label cannot be removed from the surface after the water-active adhesive has dried, the substrate in accordance with the present invention has a tensile strength less than a tensile strength necessary to separate the substrate from the water-active adhesive, or the surface, after its first application to the surface. Because the tensile strength is less than is necessary for separation of the substrate, the substrate tears when it is pulled from the first application, thus rendering it useless for subsequent application, or identified by the tear marks so it would not be accepted.

In addition, thermosensitive color-forming layer is disposed on an opposite side of the substrate which provides means for enabling the display of alphanumerica characters and/or designed by selective application of heat thereto. Because the color-forming layer is thermosensitive, the alphanumeric display is marked or obliterated by additional color formation upon subsequent non-selected heating of the thermosensitive lable, as may occur during the application of heat to the thermosensitive label in order to remove the thermosensitive label from its first application to a surface.

More particularly, the thermosensitive color-forming layer may comprise a colorless or light-colored leuco dye and an acidic substance capable of causing said leuco dye to undergo color formation upon heating of the thermosensitive label to a temperature greater than an activation temperature which may be at most 60° C.

Specifically, to ensure tearing of the substrate upon attempt at removal, the dry tensile strength of the substrate is less than a dry tensile strength necessary to separate the substrate from the surface when the surface is dry, and a wet tensile strength of the substrate is less than a wet tensile strength necessary to separate the substrate from the surface when the adhesive is moistened.

The remoistenable adhesive may comprise a casein-vinyl acetate which is applied in a thickness of between about 0.5 mil and about 1.5 mil to the substrate which comprise uncoated paper stock having a weight between about 40 and about 65 grams per square meter, and a thickness of between about 50 and about 85 micrometers, respectively.

In order to prevent unwanted color formation or fading of the thermosensitive color-forming layer which may be due to contact therewith from exterior contaminants and for inhibiting moisture from penetrating through the thermosensitive color-forming layer means and substrate and into the water-activated adhesive, a barrier layer may be provided over the color-forming layer.

BRIEF DESCRIPTION OF THE DRAWINGS

A better understanding of the present invention may be had from the consideration of the following detailed description, taken in conjunction with the accompanying drawings, in which.

DETAILED DESCRIPTION

Figure 1:
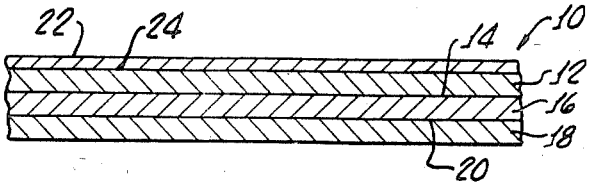
FIG. 1 is a cross-sectional view of the thermosensitive label rendered unusable by removal from its first application, generally showing each of the layers.

Turning to FIG. 1, a thermosensitive label 10 rendered unusable by removal from its first application in accordance with the present invention, is shown in cross-section with a thermosensitive color-forming layer 12 disposed on one side 14 of a substrate 16 and a remoistenable adhesive 18 disposed on an opposite side 20 of the substrate 16. Also shown is a barrier layer 22 disposed over a top surface 24 of the thermosensitive color-forming layer 12. The barrier layer 22 provides a means for preventing undesired color formation and/or fading of desired color formation or images, 26 (FIGS. 2, 3, 4) in the color-forming layer by exterior contaminants and a means for preventing, or inhibiting, moisture from penetrating through the color-forming layer 12.

In general, the thermosensitive color-forming layer 12 may be of any suitable combination in which a display of images is produced when the temperature of selected portions of the thermosensitive color-forming layer are heated above an activated temperature. Such layers are well known in the art and may include a colorless or light-colored leuco dye and an acidic substance, such as described in U.S. Pat. Nos. 4,370,370 and 4,388,382.

In use, a heated printing head (not shown) may be utilized to selectively heat portions of the color-forming layer, as is well known in the art. In this manner, the thermosensitive color-forming layer 12 provides a means for creating a display of images 20 without the use of oily or water-based inks.

It is important that the substrate be selected on the basis of its tensile strength in order that the label cannot be separated from its first application without tearing thereof. Uncoated paper stock may be used at considerable cost savings, because the hereinafter described remoistenable adhesive layer 18 does not include any components which would cause color formation or fading of color images 26 in the thermosensitive color-forming layer should they migrate through the substrate and into the color-forming layer 12.

Turning to the remoistenable adhesive layer 18, it has been found that certain adhesives may be successfully used without a barrier layer between the adhesives and the color-forming layer 12, and such adhesives are those that comprise components not causing color formation or fading of images created in the color-forming layer. Such components causing degradation to the color-forming layer include plasticizers and binders are found in common organic-solvent-type adhesives.

Remoistenable adhesives suitable in the present invention comprise water-soluble or water dispersible components such as casein-vinyl acetate adhesives.

In order to enable manufacture, the label in accordance with the present invention, at commercial production rates, it has been found that a remoistenable adhesive comprising casein-vinyl acetate, suitable in the present invention, may have a solids content of at least about 70 percent by weight when applied to the opposite side 20 of the substrate 16. A suitable casein-vinyl acetate adhesive is available from National Starch and Chemical Corporation of Bridgewater, N.J., under the trade name of Royaldex 32-3405, or 32-3391.

A suitable commercial manufacturing rate for the label of the present invention is between about 90 meters and about 120 meters per minute, which means that the adhesive must be dried, after application to the substrate 16, in between about 7 and about 12 seconds.

This drying, of course, must be accomplished without heating of the label, and color-forming layer 12 thereon, below the activation temperature of the thermosensitive color-forming layer, the latter typically being at most about 60 degrees centigrade. Activation temperature, as the term is used in this specification, is meant to be the initial activation temperature of the color-forming layer. As is well known in the art, the activation of a color-forming layer begins at a temperature at which color formation first occurs. Higher temperatures cause color formation with a higher optical density. In the color-forming layer useful in the present invention, it is expected that a maximum color density occurs at temperatures above about 100°0 C.

It has been found that drying speeds in this order can be achieved when the remoistenable adhesive layer 18 is applied with a thickness of between about 0.5 mil and 1.5 mil and thereafter air dried with room temperature air blown over the layer at about 17 $m^3$ per minute. It should be appreciated that the thickness of the adhesive, the temperature of the adhesive, and the amount of air necessary to dry the adhesive in the prescribed time, are all interrelated. In addition, the viscosity of the adhesive is known to vary with temperature, as set forth in Table 1. Hence, it should be appreciated that these perimeters can be adjusted and determined by a simple trial and error experimentation through a variation thereof, to enable high speed commercial production of the label by quick drying of the remoistenable adhesive on the substrate.

TABLE I

| TEMPERATURE vs. VISCOSITY TABLE - 32-3405 | |
|---|---|
| TEMPERATURE (°F./C.) | VISCOSITY (CPS) |
| 70/21.1 | 7,750 |
| 75/23.9 | 7,000 |
| 80/26.7 | 5,800 |
| 85/29.4 | 5,200 |
| 90/35.2 | 4,250 |
| 90/35.0 | 4,100 |
| 100/37.8 | 3,550 |
| 105/40.8 | 3,450 |
| 110/43.3 | 3,300 |
| 115/46.1 | 2,900 |
| 120/48.9 | 2,000 |

In one embodiment of the present invention the adhesive may be a vinyl adhesive having a solids content of about 71 percent, with a viscosity of about 7000 cps at room temperature and can be applied in a conventional manner onto the substrate 16, as hereinafter described.

Suitable substrates 16 for use in the present invention in combination with the casein-vinyl acetate adhesive (National Starch and Chemical Royaldex 32-3405) include 42 g/$m^2$ uncoated paper of good formation having a dry tensile strength of about 3.2 kg/15 mm. That is, a force of 3.2 kg is necessary to tear, or rupture, a 15 mm wide single sheet of the paper. The wet tensile strength should be about 0.4 kg/15 mm.

It should be appreciated that the necessary tensile strength is dependent, in part, on the type of adhesive as well as the thickness of the adhesive, but can be empirically determined for each selected adhesive and thickness of application.

Figure 2:
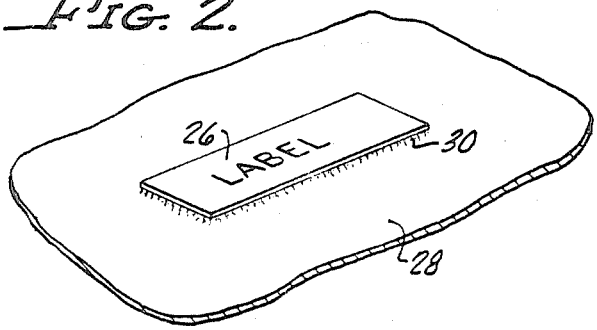
FIG. 2 is a perspective view of the label in accordance with the present invention in place on a porous surface, showing some penetration of the remoistenable adhesive thereon, into the porous surface.
Figure 3:
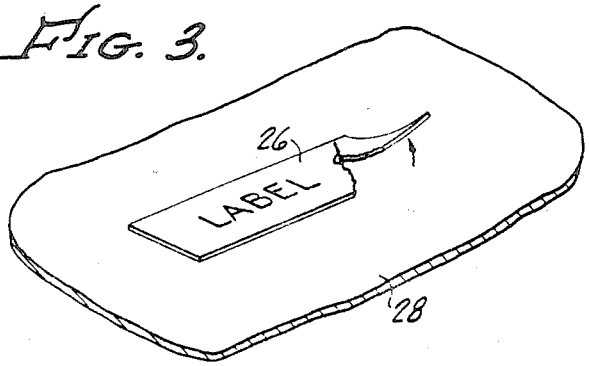
FIG. 3 is a perspective view of the label in accordance with the present invention showing the tearing thereof as an attempt is made to remove it from the surface of the first application which is caused by the tensile strength of the substrate being less than that necessary to remove the label from the surface, or separated from the remoistenable adhesive.

As represented in FIG. 2 when the label 10 is applied to a porous, or fibrous, surface, 28, such as paper or cardboard, a portion 30 of the moistened adhesive layer 18 may be adsorbed into the fibrous surface, thus hastening the drying thereof and the adhesion to the surface. Consequently, on such surfaces of application, which are typical for postal-type labels, the security of the label is insured because of tearing of the label upon attempted removal is further enhanced as represented in FIG. 3.

When it is expected that a label in accordance with the present invention may be subjected to contaminants in the atmosphere, such as oils or plasticizers on adjacent goods which may migrate into the color-forming layer, through a top surface 24 thereon, the barrier layer 22 shown in FIG. 1 may be utilized. Additionally, the barrier layer also functions to prevent curl of the labels which facilitate handling thereof.

Figure 4:
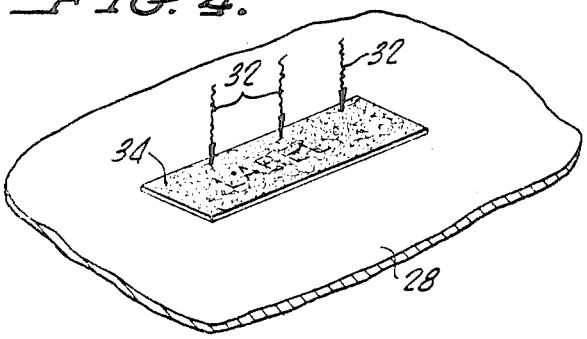
FIG. 4 is a perspective view including a representation of the heating of the label which causes discoloration of the color-forming layer therein, thereby rendering the label unusable for subsequent use if heat is used in an attempt to remove it from the surface.

This barrier layer 22 may be any suitable water-soluble resin solution which is supplied by sufficient thickness to prevent subsequent deterioration of the thermosensitive color-forming layer 12, via exterior contaminants such as oils and plasticizers. In addition, the barrier layer 22 may be used to inhibit moisture penetration through the color-forming layer 12 and substrate 16 and into the remoistenable adhesive 18 as may occur if the label is subjected to steam, as indicated by the arrows 32 in FIG. 4, in an effort to remove the label 10 from the surface 28. As represented in FIG. 4, the application of heat caused color formation 34 in the color-forming label 12, thus rendering the label 10 useless for subsequent use as a postage-type label.

Figure 5:
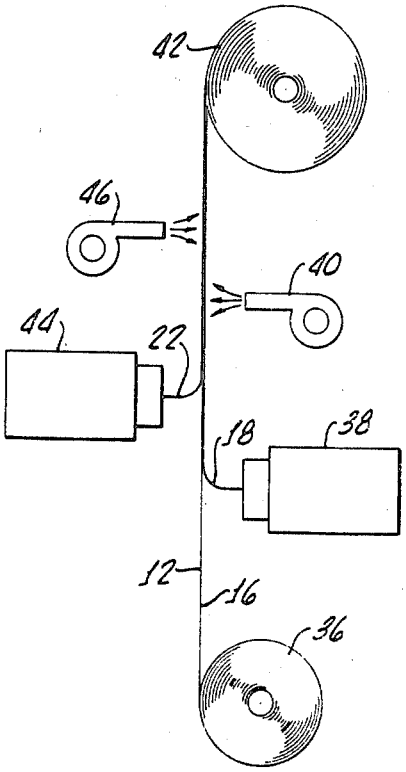
FIG. 5 is a diagram showing the production of a thermosensitive recording label with remoistenable adhesive in accordance with the present invention showing the application and drying of a remoistenable adhesive on a substrate, as well as the application of a color-forming layer and a barrier layer onto the substrate and color-forming layer, respectively.

As generally shown in FIG. 5, the adhesive layer 18 may be applied to the substrate 16 onto which the thermosensitive color-forming layer 12 has already been disposed and provided in the form of a roll 36.

It is important to appreciate that the color-forming layer 12 is disposed on the substrate 16 in a conventional manner and that, as is well known, this process is preferably executed with the substrate having adhesive already disposed thereon, because the water-based color-forming layer must be applied in liquid form and dried. In this operation, water and humidity will activate the remoistenable adhesive and cause unwanted adhesion to equipment and gumming up of the label. Hence, it is expected that for commercial production, the adhesive layer is preferably disposed onto the substrate, subsequent to the placement of the thermosensitive color-forming layer thereon.

As shown in FIG. 5, the adhesive 18 may be applied by a conventional extruder 38, or roller (not shown) and thereafter air dried with a blower 40 without reaching the activation temperature of the thermosensitive color-forming layer 12 before it is formed into a roll 42 for storage.

The barrier layer 22 may be placed onto the thermosensitive color-forming layer shortly after the placement of the color-forming layer 12 on the substrate 16. It also may be applied in a conventional manner by an extruder 44 or the like, in a contemporaneous manner, with the adhesive, and thereafter dried by passing past a blower 46.

The following example is presented by way of illustration only, and is not to be considered limiting to the present invention.

EXAMPLE 1

A solution of leuco dye and acid substance was prepared as follows:

| | Parts by Weight |
|---|---|
| Dispersant A | |
| 3-diethyl-6-methyl-7-anilino fluoran | 1.5 |
| Polyvinyl alcohol (20% aqueous | 5.0 |

-continued

| | Parts by Weight |
|---|---|
| solution) | |
| Water | 43.5 |
| Dispersant B | |
| Bisphenol A | 6.0 |
| Stearic acid amide | 1.0 |
| Polyvinyl alcohol (20% aqueous solution) | 10.0 |
| Water | 33.0 |

The prepared Dispersant A and Dispersant B were mixed to form a thermosensitive coloring liquid which was applied to a substrate consisting of high quality uncoated paper weighting about 42 gr./m$^2$ at the hereinabove recited tensile strengths. Thereafter, the liquid was dried at a temperature up to 60° C. to form a thermosensitive color-forming layer in which the solids therein amounted to about 4.0 to about 10 gr./m$^2$. A water-soluble resin solution comprising 5 parts of polyvinyl alcohol in 95 parts of water was applied to the heat-sensitive color-forming layer and dried at a temperature less than 100° C. to thereby form a barrier layer over the thermosensitive color-forming layer, said barrier layer having a quantity of solids of about 2 gr./m$^2$.

A casein-vinyl acetate adhesive (National Starch and Chemical Royaldex 32-3405) having a solids content of about 71 percent was applied with a viscosity of about 7000 cps at about 24° C. and blown dried with air at less than 60° C. in about 10 seconds, with a resulting dried thickness of adhesive of about 1 mil.

The resulting label was then contacted with a heated printing head to cause a preselected image 26 to form in the color-forming layer and the label was then applied to cardboard stock by moistening the remoistenable adhesive and contacting it with the cardboard stock. No curling of the label was observed and no color formation occurred in the color-forming layer during production thereof and no subsequent color fading of the preselected image or unwanted color formation occurred following application of the label to the paper stock. Attempts to remove the label 10 from the first application without tearing of the label were unsuccessful by peeling the label (whether dry or wet) or with heat without tearing or causing the label to incur additional color formation.

Although there has been described hereinabove a specific thermal label with remoistenable adhesive and method of manufacture in accordance with the present invention for the purposes of illustrating the manner in which the invention may be used to advantage, it should be appreciated that the invention is not limited thereto. Accordingly, any and all modifications, variations or equivalent arrangements which may occur to those skilled in the art should be considered to be within the scope of the invention as defined in the appended claims.

What is claimed is:

1. A thermosensitive label rendered unusable by removal from its first application to a surface, said thermosensitive label comprising:

a substrate;

water-activated adhesive means for attaching said substrate to the surface, said water-activated adhesive means being disposed on one side of said substrate;

said substrate having a tensile strength less than a tensile strength necessary to separate the substrate from the water-activated adhesive, or surface, after first application to the surface causing the substrate to tear as the thermosensitive label is pulled from its first application to the surface; and thermosensitive color-forming layer means, disposed on an opposite side of the substrate, for enabling the display of alphanumeric characters and/or designs by selective application of heat thereto, said display being marked or obliterated by additional color formation in the color-forming layer upon subsequent non-selective heating of the thermosensitive label as may occur during the application of heat to the thermosensitive label in order to remove the thermosensitive label from its first application to the surface.

2. The thermosensitive label according to claim 1 wherein the thermosensitive color-forming layer comprises a colorless or light-colored leuco dye and an acidic substance capable of causing said leuco dye to undergo color formation upon heating of the thermosensitive label to a temperature greater than an activation temperature.

3. The thermosensitive label according to claim 2 wherein the activation temperature is at most 60° C.

4. The thermosensitive label according to claim 3 wherein a dry tensile strength of the substrate is less than a dry tensile strength necessary to separate the substrate from the surface when the adhesive is dry and a wet tensile strength of the substrate is less than a wet tensile strength necessary to separate the substrate from the surface when the adhesive is moistened.

5. The thermosensitive label according to claim 4 wherein the surface comprises paper or cardboard stock and the water-activated adhesive comprises a casein-vinyl acetate.

6. The thermosensitive label according to claim 5 wherein the casein-vinyl acetate has a thickness of between about 0.5 mil and about 1.5 mil.

7. The thermosensitive-label according to claim 6 wherein the substrate comprises uncoated paper stock having a weight of between about 40 and about 65 grans/sq. meter, and a thickness of between about 50 and about 85 micrometers, respectively.

8. The thermosensitive label according to claim 7 further comprises moisture barrier means disposed over said thermosensitive color-forming layer means for preventing moisture from penetrating through the thermosensitive color-forming layer means and substrate and into the water-activated adhesive means and for prevention of exterior contaminants from causing unwanted color formation and/or fading in the thermosensitive color-forming layer.

9. The thermosensitive label according to claim 8 wherein said moisture barrier means is of sufficient thickness to prevent curling of the thermosensitive label.

10. A thermosensitive label rendered unusable by removal from its first application to a porous surface, said thermosensitive label comprising;

a substrate comprising uncoated paper stock;

water-activated adhesive means, comprising a single adhesive layer, for penetrating the porous surface in order to adhere the substrate thereto, said water-activated adhesive means being disposed on one side of said substrate;

said substrate having a tensile strength less than a tensile strength necessary to separate the substrate from the water-activated adhesive or porous surface after first application to the porous surface in order that the substrate causing to tear as the thermosensitive label is pulled from its first application to the porous surface; and thermosensitive color-forming layer means, disposed on an opposite side of the substrate for enabling the display of alphanumeric characters and/or designs by selective application of heat thereto, said display being marked or obliterated by additional color formation in the color-forming layer upon subsequent nonselective heating of the thermosensitive label as may occur during the application of heat to the thermosensitive label in order to remove the thermosensitive label from its first application to the porous surface.

11. The thermosensitive label according to claim 10 wherein the thermosensitive color-forming layer comprises a colorless or light-colored leuco dye and an acidic substance capable of causing said leuco dye to undergo color formation upon heating of the thermosensitive label to a temperature greater than an activation temperature.

12. The thermosensitive label according to claim 11 wherein the activation temperature is at most 60° C.

13. The thermosensitive label according to claim 12 wherein a dry tensile strength of the substrate is less than a dry tensile strength necessary to separate the substrate from the surface when the adhesive is dry and a wet tensile strength of the substrate is less than a wet tensile strength necessary to separate the substrate from the surface when the adhesive is moistened.

14. The thermosensitive label according to claim 13 wherein the porous surface comprises paper or carboard stock and the water-activated adhesive comprises a casein-vinyl acetate.

15. The thermosensitive label according to claim 14 wherein the casein-vinyl acetate has a thickness of between about 0.5 mil and about 1.5 mil.

16. The thermosensitive label according to claim 15 wherein the substrate comprises uncoated paper stock having a weight of between about 40 and about 65 grans/sq. meter, and a thickness of between about 50 and about 85 micrometers, respectively.

17. The thermosensitive label according to claim 16 further comprises moisture barrier means disposed over said thermosensitive color-forming layer means for preventing moisture from penetrating through the thermosensitive color-forming layer means and substrate and into the water-activated adhesive means and for preventing exterior contaminants from causing unwanted color formation and/or fading in the color-forming layer.

18. The thermosensitive label according to claim 17 wherein said moisture barrier means is of sufficient thickness to prevent curling of the thermosensitive label.

* * * * *